US006328081B1

(12) United States Patent
Gotti et al.

(10) Patent No.: US 6,328,081 B1
(45) Date of Patent: Dec. 11, 2001

(54) WEFT TENSION BRAKE CONTROL

(75) Inventors: Luca Gotti, Albino; Pietro Zenoni, Leffe, both of (IT)

(73) Assignee: L.G.L. Electronics S.p.A., Gandino (IT)

( * ) Notice: Subject to any disclaimer, the term of this patent is extended or adjusted under 35 U.S.C. 154(b) by 0 days.

(21) Appl. No.: 09/721,993

(22) Filed: Nov. 27, 2000

(30) Foreign Application Priority Data

Nov. 30, 1999 (IT) ..... TO99A1048

(51) Int. Cl.[7] ..... D03D 47/34; B65H 59/24

(52) U.S. Cl. ..... 139/450; 318/6; 242/419.4; 139/194

(58) Field of Search ..... 318/7, 6; 242/419.4; 139/450, 194

(56) References Cited

U.S. PATENT DOCUMENTS 4,513,790 * 4/1985 Sainen et al. ..... 139/110
5,050,648 * 9/1991 Pezzoli ..... 139/450
5,476,122 * 12/1995 Schuster et al. ..... 139/194
5,544,680 * 8/1996 De Ro ..... 139/450

FOREIGN PATENT DOCUMENTS 0 622 485 11/1994 (EP) .
0 634 509 1/1995 (EP) .

* cited by examiner

*Primary Examiner*—Andy Falik
(74) *Attorney, Agent, or Firm*—Guido Modiano; Albert Josif; Daniel O'Byrne

(57) ABSTRACT

A method for controlling electrically actuated weft brakes for automatically adjusting mechanical tension of a weft thread in textile machines with mechanical insertion, comprising the steps of: generating and modulating an excitation current of an actuator of an electrically actuated brake. The above step is performed with a device which comprises a control chip which is sensitive both to variations of mechanical tension measured on the left thread and to an actual value (v) of a travel speed of the weft thread during insertion; the control loop is adapted to recondition a reference parameter of the braking action, determined by the control loop on the basis of a reference tension and a measured tension, with a multiplication factor which is represented by a decreasing function [f(v)] of the actual value (v) of the travel speed of the weft thread.

8 Claims, 2 Drawing Sheets

WEFT TENSION BRAKE CONTROL

BACKGROUND OF THE INVENTION

The present invention relates to a method and a device for controlling electrically actuated weft brakes for the automatic adjustment of the mechanical tension of a weft thread in textile machines with mechanical insertion; this expression is used to designate textile machines such as gripper looms, bullet looms and picking-type machines in which the weft thread is engaged mechanically by transport elements in order to be inserted in the shed; fluid-jet weft insertion machines are therefore excluded.

As it is known, in modern weaving systems the weft thread that unwinds from the spool is fed to the loom by means of a weft feeder. Such weft feeder is an apparatus which comprises a fixed drum on which a rotating arm winds and restores a plurality of turns of thread which constitute a weft reserve and from which the turns unwind when requested by the loom, at each beat thereof.

Electrically-actuated weft braking devices are inserted between the feeder and the loom and have the dual purpose of maintaining on the thread a sufficiently high mechanical tension in certain critical steps of the weft insertion process and of ensuring that in any case, throughout the insertion process, the instantaneous or peak value of the mechanical tension does not reach excessively high values such as to break the thread, for example at defective points of the thread. The critical steps of the insertion process in which correct control of weft thread tension is indispensable are constituted, e.g. in a gripper loom, by the thread gripping step, by the step for transfer between the retaining gripper and the drawing gripper, and by the step for the arrival of the weft thread.

In order to achieve such dual purpose, the use of weft braking means which are integrated in the feeder and/or separated from it is known.

The present description non-limitatively relates to the latter means, i.e. the so-called duckbill brakes arranged downstream of the feeder and comprising a pair of mutually opposite laminas, respectively a fixed one and a movable one, between which the thread runs and in which an electromechanical actuator actuates the movable lamina so as to press more or less intensely on the fixed one in order to vary the applied braking action. As it is also known, the actuator of the brake is driven with an excitation current modulated by a tension sensor which is inserted between the weft brake and the weaving loom and generates a modulation signal for the excitation current which is proportional to the instantaneous value of the mechanical tension of the weft thread.

More specifically, weft thread tension adjustment systems are known which use, in order to control the weft brake, an adjustment loop in which the reference is constituted by a preset and selected value of the mechanical tension of the weft thread and in which the instantaneous and actual value of the tension, measured by a tension sensor, is subtracted from the reference value in order to obtain an error signal. The error signal is processed by logic means (logic block of the PID type), which obtain an information signal capable of eliminating the error.

This information signal is matched, by means of adequate power circuits, by a proportional braking action applied by the laminar brake to the weft thread; the information signal is therefore termed "brake reference" hereinafter.

This conventional weft brake adjustment and control system, based exclusively on the direct measurement of the mechanical tension that affects the weft thread, despite being widely used, does not fully meet the requirements of modem weaving processes, since it is unable to compensate, sufficiently to avoid unwanted breakages of the weft thread, the rapid variations in mechanical tension to which the thread is subjected during the insertion process.

This severe drawback is substantially due to the fact that the braking action applied by the laminar brake or by other conventional types of driven brakes is heavily influenced by the travel speed of the thread, so that the mechanical tension generated on the weft thread, for an equal braking action applied by the brake, is just as directly dependent on the travel speed.

It is thus evident that the conventional above-cited adjustment systems are entirely insufficient and inadequate in weaving processes with mechanical insertion in which insertion speeds on the order of 2500 or 3000 meters/minute are easily reached and exceeded, and in which, during the insertion steps, the weft is subjected to the intense accelerations and decelerations that characterize the rules of motion of the thread transport elements.

In particular in the case of gripper looms, with reference to the angular positions of the driving shaft of the machine and as shown in the solid-line chart line of FIG. 2, the step for gripping the weft thread occurs at approximately 65 shaft degrees. After this, the thread is subjected to a step of transport with a high initial acceleration up to approximately 120 shaft degrees, followed by a deceleration, due to braking, until approximately 180 shaft degrees are reached, this being the position for transfer between the retaining gripper and the drawing gripper. Such drawing gripper, over the remaining arc of the insertion step, subjects the thread to an acceleration-deceleration cycle which is substantially identical to the preceding one, ending insertion at approximately 287 shaft degrees.

Correspondingly, the mechanical tension on the weft thread varies substantially according to the same rule of variation as the thread travel speed and therefore has the plot of the dashed chart line of FIG. 2, which is also substantially characterized by two positive half-waves having a minimum cusp which lies substantially at the 180 shaft degrees position; such minimum value, different from zero, corresponds to the value of the static tension that acts on the thread at rest.

SUMMARY OF THE INVENTION

The aim of the present invention, starting from the notion of the variability of the mechanical tension on the weft thread, which is markedly and increasingly linked to the corresponding variability of the thread travel speed during the insertion step, is to provide a method and a device for adjusting the mechanical tension of the weft thread with a loop for generating and controlling the excitation current of the weft brake which is sensitive not only to the variations in the mechanical tension measured on the weft thread but also to the variations in the travel speed of the thread; such speed variations being derived from the rule of motion that governs the mechanical elements for the insertion of the weft thread.

Within the scope of this aim, an object of the present invention is substantially to provide a method and a device for controlling weft brakes which have a highly improved functionality and ensure the substantial absence of weft thread breakage even in the presence of particularly delicate wefts such as wools, silks and low-count synthetic yams.

Another important object of the present invention is to provide a control method which is extremely simple and a control device which is quite inexpensive and has a minimal number of sensors (which are expensive and scarcely reliable) arranged along the path of the weft thread.

According to the present invention, this aim, these and other objects which will become better apparent hereinafter from the following detailed description are achieved with a method and a device which have the specific characteristics stated in the appended claims.

Substantially, the present invention is based on the concept of improving the adjustment loop of conventional types of device by rescaling the braking reference, or brake reference for short, according to the actual instantaneous transport speed of the weft thread.

In other words, the present invention provides an adjustment device with a control loop for generating the excitation current of the weft brake, in which the brake reference parameter, obtained from the difference between the reference and measured mechanical tensions on the thread, is reconditioned by a multiplication factor which is adapted to make it consistently dependent on the actual travel speed of the weft thread, represented by a decreasing function of the actual travel speed; the travel speed being obtained indirectly from a signal which is taken from the weaving loom and is representative of the absolute angular position of the driving shaft of said loom.

BRIEF DESCRIPTION OF THE DRAWINGS

The characteristics, purposes and advantages of the method and device according to the present invention will become better apparent from the following detailed description and with reference to the accompanying drawings, given by way of non-limitative example, wherein.

DESCRIPTION OF THE PREFERRED EMBODIMENTS

Figure 1:
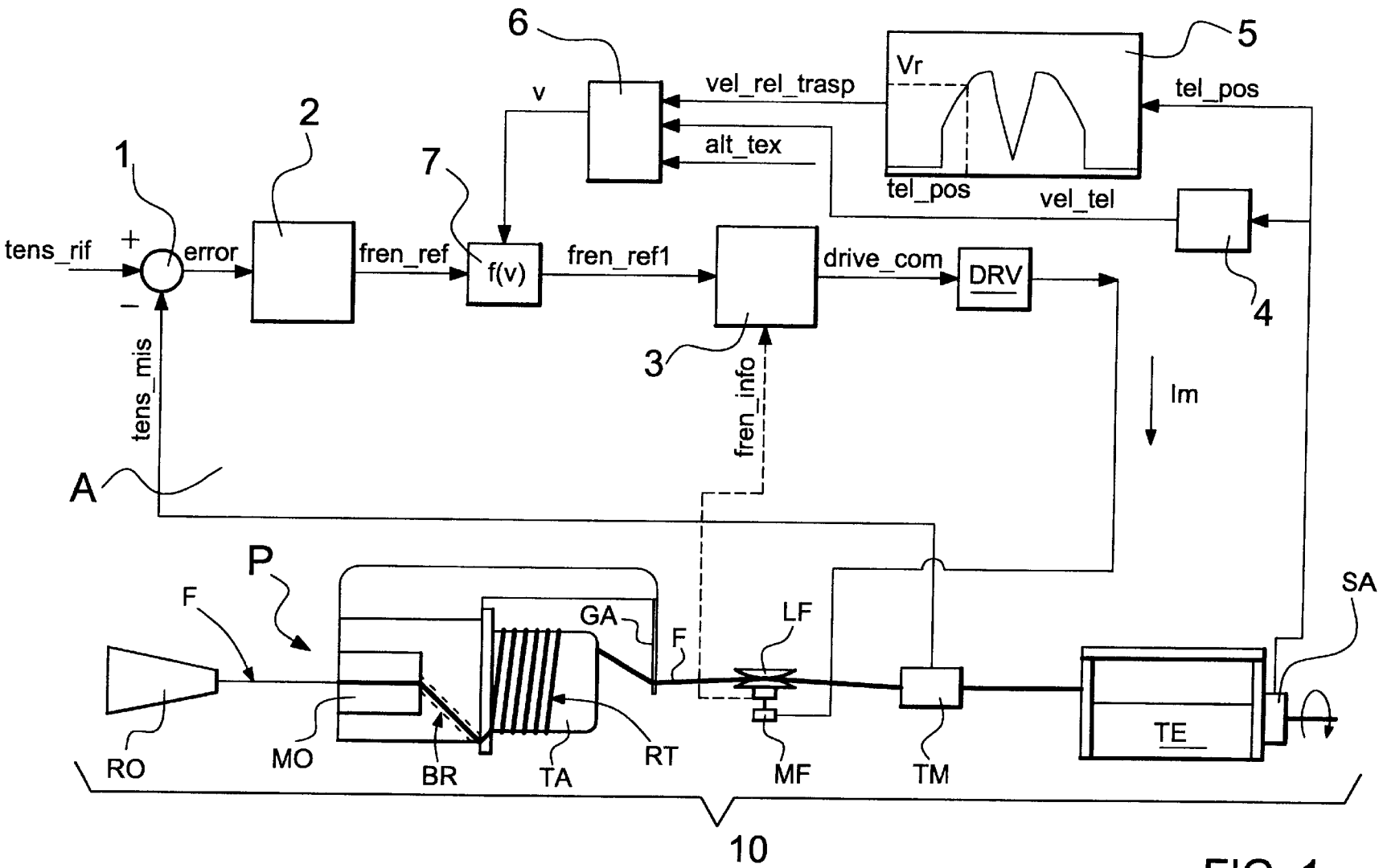
FIG. 1 is an electrical block diagram of the control device according to the present invention.

In FIG. 1, the reference numeral 10 designates a typical system for feeding the weft thread F to a loom TE of the type with mechanical insertion, which comprises a spool RO of weft thread, a weft feeder P, a weft brake LF, e.g. of the type with mutually opposite laminas, which is interposed between the feeder P and the loom TE and a sensor TM for the direct measurement of the instantaneous value of the mechanical tension T on the thread F; sensor TM is inserted directly downstream of the brake LF.

In a per se known manner, the feeder P comprises a drum TA on which a rotating arm BR, actuated by a motor MO, winds and restores a plurality of turns of thread which constitute a weft reserve RT and which, when requested by the loom TE, unwind from the drum TA at each weft insertion, passing through a thread guide GA.

Likewise, in a per se known manner, the brake LF comprises a fixed lamina and a movable lamina, between which the thread F passes, and an electromechanical actuator MF which is supplied by an excitation current modulated by a signal emitted by the sensor TM and presses more or less intensely the movable lamina against the fixed one, varying the degree of braking applied to the thread F.

For this purpose, the sensor TM generates a signal tens-mis which substantially represents the feedback signal of the control loop of the device, which is generally designated by A.

Such control loop A comprises a subtracting logic block 1, in which the signal tens-mis is subtracted from a reference signal tens-rif representing the value of the intended mechanical tension of the weft thread F. At the output of the subtraction block 1 there is therefore provided an error signal error which represents the difference between the reference tension and the tension measured at the instant being considered; said signal error is sent to the input of a known PID (proportional-integral-derivative) regulator, designated by the reference numeral 2, which obtains a brake reference information signal fren-ref which is such as to cancel out the error signal error.

In conventional types of device, the signal fren-ref directly generates, by means of a logic block 3 and a power circuit DRV, an excitation current which allows the brake LF to develop a corresponding braking action which is substantially proportional to the information signal fren-ref, and the loop preferably closes with an additional feedback signal fren-info (constituted for example by a portion of a current Im that circulates in the actuator MF of the brake LF) sent to the block 3.

According to the present invention, the control loop A of the device is rendered sensitive not only to the mechanical tension (T) but also consistently sensitive to the variations in the transport velocity of the weft thread F during the several steps of weft insertion.

Figure 2:
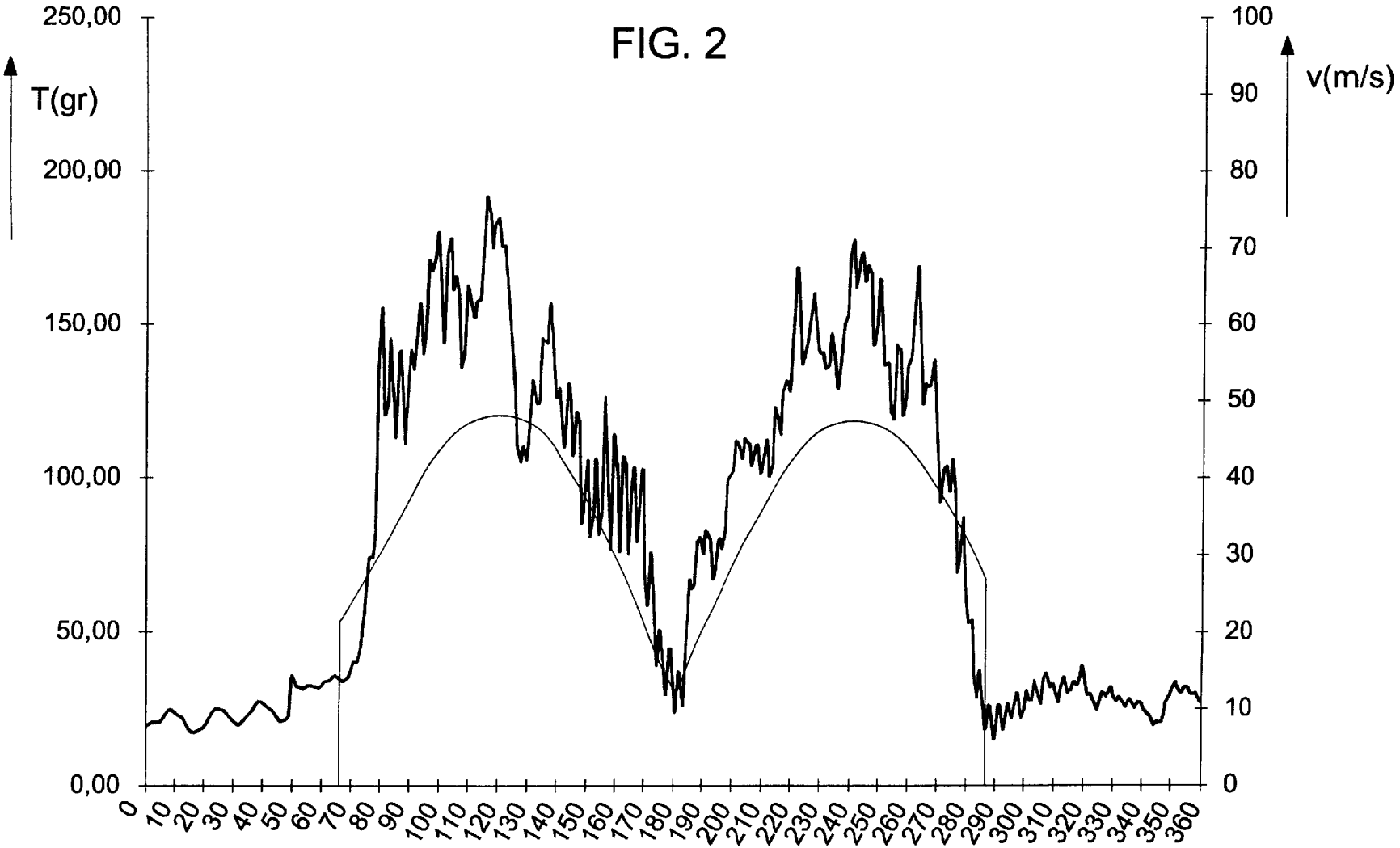
FIG. 2 is an example chart which plots the transport speed (V), in meters per second, of the weft thread and the mechanical tension (T), in grams, that acts on the thread as a function of the angular position of the shaft of the loom, expressed in shaft degrees; the example considered refers to a loom with a height of 3.6 meters and with an angular shaft velocity of 360 rpm.

This is achieved, according to the invention, by reconditioning the brake reference variable fren-ref by means of a multiplication factor which is substantially represented by a decreasing function of the actual travel speed v of the weft thread. For this purpose, the shaft of the loom TE is provided with an angular position sensor SA which can provide, moment by moment, a signal tel-pos of the angular position of the shaft expressed in shaft degrees and variable from zero to 360°. The signal tel-pos is sent simultaneously to two logic blocks 4 and 5: the first block is a simple derivation block which provides in output a data item vel-tel corresponding to the angular speed of the loom. The second one of said blocks instead contains the function represented by the solid-line curve of the chart of FIG. 2 and thus processes, according to the shaft degrees, a signal vel-rel-trasp which represents the relative speed (Vr) of transport of the weft at the instant and for the loom TE being considered.

The outputs of the blocks 4 and 5 are sent, together with the additional parameter alt-tex corresponding to the height of the fabric being manufactured, to a logic block 6 which, by multiplying the three input signals, provides in output the variable v which represents the actual transport speed of the weft expressed in meters/minute. This variable is sent to a multiplier logic block 7 which multiplies the brake reference fren-ref that is present at the output of the block 2 by a decreasing function f(v) of the transport speed, obtaining, in accordance with the stated aim and objects, a brake reference fren-ref1 which is reconditioned according to the weft transport speed v.

Typically, according to the invention, the decreasing function f(v) is of the type:

$$f(v)=K/v$$

where K is a constant which is selected in relation to the required amplitude and speed of the response of the described adjustment system.

Without altering the concept of the invention, the details of execution and the embodiments may of course be varied extensively with respect to what has been described and illustrated by way of non-limitative example without thereby abandoning the scope of the invention.

The disclosures in Italian Patent Application No. TO99A001048 from which this application claims priority are incorporated herein by reference.

What is claimed is:

1. A method for controlling electrically actuated weft brakes for automatically adjusting mechanical tension of a weft thread in textile machines with mechanical insertion, comprising the steps of:

generating and modulating an excitation current of an actuator of an electrically actuated brake with a device which comprises a control loop which is sensitive both to variations of mechanical tension measured on the weft thread and to an actual value (v) of a travel speed of the weft thread during insertion; and reconditioning, by said control loop, a reference parameter of the braking action, determined by said control loop on the basis of a reference tension and a measured tension, with a multiplication factor which is represented by a decreasing function [f(v)] of said actual value (v) of the travel speed of the weft thread.

2. The control method according to claim 1, comprising a step of indirectly obtaining the actual speed (v) of the weft thread, during insertion from a curve that represents a relative speed of transport of the weft thread as a function of an angular position of a driving shaft of a textile machine expressed in shaft degrees.

3. The control method according to claim 2, wherein the actual speed (v) of the weft thread is obtained by multiplying three parameters which are constituted by the relative speed of transport of the thread, an angular velocity of the shaft of the textile machine and a height of a fabric being manufactured.

4. The control method according to claim 1, wherein said decreasing function [f(v)] of the actual value of travel speed of the weft thread is represented by an expression of the type:

$$f(v)=K/v$$

where v is said actual speed and K is a constant selected in relation to a required amplitude and response speed of the adjustment loop.

5. A device for controlling electrically actuated weft brakes which automatically adjust mechanical tension of the weft thread in textile machines with mechanical insertion, comprising; a sensor element for detecting mechanical tension of a thread which is adapted to be arranged downstream of the weft brake and for providing a signal which is proportional to a detected tension; first functional logic means which are adapted to subtract said detected tension signal from a reference value and to extract an information signal which constitutes a reference parameter of a braking action, capable of cancelling out any error produced by a subtraction of said measured and reference values of the tension; an additional sensor for detecting an angular position of a driving shaft of the textile machine; second functional logic means which are adapted to process a signal of the angular position sensor in order to provide a variable (v) which represents an actual transport speed of the thread during weft insertion; and a third functional logic means which is adapted to recondition said reference parameter of the braking action and make it consistently dependent on the actual travel speed (v) of the weft thread, by multiplying said parameter by a multiplication factor [f(v)] which is represented by a decreasing function of said travel speed (v).

6. The device according to claim 5, wherein said first functional logic means are constituted by a subtraction block and by a PID regulator.

7. The device according to claim 5, wherein said second functional logic means are constituted by a derivation unit which provides an angular speed of the shaft of the textile machine, by a processing unit which is adapted to extract a relative speed of weft thread transport as a function of an angular movement of the motor shaft of the textile machine expressed in shaft degrees, and by a multiplier which provides the actual value (v) of the travel speed of the thread obtained from a multiplication of the parameters constituted by said angular speed and said relative speed and by a height of a fabric being manufactured by said textile machine.

8. The device according to claim 7, wherein the multiplication factor for reconditioning the reference parameter of the braking action is represented by a function $$f(v)=K/v$$

where v is the actual travel speed of the thread and K is a constant which is selected in relation to a required amplitude and response speed of the adjustment loop.

* * * * *